US012016447B2

(12) United States Patent
Bowerman

(10) Patent No.: US 12,016,447 B2
(45) Date of Patent: Jun. 25, 2024

(54) CONFIGURABLE BAG HAVING FACEPLATES

(71) Applicant: James Patrick Bowerman, Savannah, GA (US)

(72) Inventor: James Patrick Bowerman, Savannah, GA (US)

(73) Assignee: BOWERBAGS LLC, Savannah, GA (US)

( * ) Notice: Subject to any disclaimer, the term of this patent is extended or adjusted under 35 U.S.C. 154(b) by 0 days.

(21) Appl. No.: 16/717,481

(22) Filed: Dec. 17, 2019

(65) Prior Publication Data

US 2020/0121062 A1 Apr. 23, 2020

Related U.S. Application Data

(63) Continuation of application No. 14/008,916, filed as application No. PCT/US2012/031373 on Mar. 30, 2012, now Pat. No. 10,506,867.

(Continued)

(51) Int. Cl.

*A45F 3/02* (2006.01)
*A45C 7/00* (2006.01)

(Continued)

(52) U.S. Cl.

CPC ..... *A45F 3/02* (2013.01); *A45C 7/0077* (2013.01); *A45C 7/0086* (2013.01); *A45C 13/00* (2013.01); *A45F 3/04* (2013.01); *A45F 2004/023* (2013.01)

(58) Field of Classification Search

CPC ... A45C 7/0077; A45C 7/0059; A45C 7/0086; A45C 7/00; A45C 2007/0013;

(Continued)

(56) References Cited

U.S. PATENT DOCUMENTS 4,697,946 A 10/1987 Röck et al.
5,031,807 A 7/1991 Tiffany (Continued)

FOREIGN PATENT DOCUMENTS

JP 2009201965 A * 9/2009

OTHER PUBLICATIONS

English Translation of JP 2009-0201965 from Japan Patent Office website, https://www.j-platpat.inpit.go.jp/.*

(Continued)

*Primary Examiner* — Scott T Mcnurlen
(74) *Attorney, Agent, or Firm* — Thomas E. Lees, LLC

(57) ABSTRACT

Disclosed is a configurable bag having a main bag compartment defined by a foldable bag body configurable between at least a first configuration and a second configuration via a folding of the bag body, the main bag compartment being accessible via a closable opening disposed in the foldable bag body when in the first configuration. The configurable bag further includes a first securing means and a second securing means affixed to the bag body, wherein the first and second securing means are disposed out of position for connection when the bag body is in the first configuration. The first and second securing means are positioned for connection via folding the bag body into the second configuration. The first and second securing means are configured to secure the bag body in the second configuration when the first securing means is secured to the second securing means.

19 Claims, 16 Drawing Sheets

Related U.S. Application Data

(60) Provisional application No. 61/628,740, filed on Nov. 4, 2011, provisional application No. 61/574,352, filed on Aug. 1, 2011, provisional application No. 61/516,346, filed on Apr. 1, 2011.

(51) Int. Cl.
*A45C 13/00* (2006.01)
*A45F 3/04* (2006.01)
*A45F 4/02* (2006.01)

(58) Field of Classification Search
CPC ..... A45C 2009/007; A45F 2004/023; A45F 3/02; A45F 3/04; A45F 3/042; A45F 3/047; A45F 3/06; A45F 2003/025; A45F 2003/045
USPC ..... 224/575, 578–584, 627, 637–659
See application file for complete search history.

(56) References Cited

U.S. PATENT DOCUMENTS

| | | | | | |
|---|---|---|---|---|---|
| 5,540,364 | A * | 7/1996 | Krieger | A63C 11/025 | 224/153 |
| 5,725,139 | A | 3/1998 | Smith | | |
| 5,762,371 | A | 6/1998 | Noguchi | | |
| 5,797,529 | A * | 8/1998 | Lavine | A45C 7/0077 | 190/103 |
| 6,029,877 | A | 2/2000 | Woods | | |
| 6,048,023 | A * | 4/2000 | Lampton | A45C 15/00 | 297/52 |
| 6,135,635 | A | 10/2000 | Miller | | |
| 6,460,746 | B1 | 10/2002 | Amram | | |
| 6,626,342 | B1 | 9/2003 | Gleason | | |
| 7,617,956 | B1 * | 11/2009 | Sabbah | A45C 5/143 | 280/37 |
| 10,912,361 | B2 | 2/2021 | Wu et al. | | |
| 2004/0065708 | A1 | 4/2004 | Amram | | |
| 2005/0017041 | A1 | 1/2005 | Roberts | | |
| 2006/0260046 | A1 | 11/2006 | Landay | | |
| 2009/0114690 | A1 | 5/2009 | Landay | | |
| 2009/0117300 | A1 * | 5/2009 | Thompson | B32B 15/14 | 428/35.2 |
| 2009/0283564 | A1 | 11/2009 | Bass | | |
| 2011/0192877 | A1 * | 8/2011 | Murdoch | A45F 3/02 | 224/607 |
| 2011/0198374 | A1 | 8/2011 | Majeau | | |
| 2012/0006865 | A1 | 1/2012 | Su | | |
| 2012/0205409 | A1 | 8/2012 | Quartarone, III | | |
| 2016/0095401 | A1 | 4/2016 | Welihozkiy | | |

OTHER PUBLICATIONS

International Search Report dated Oct. 30, 2012; re: PCT/US2012/031373; citing U.S. Pat. No. 5,797,629A, US20090114690A1, and US20060260046A1.

International Search Report and Written Opinion for PCT/US2022/074774, dated Feb. 17, 2023, 5 pgs.

* cited by examiner

CONFIGURABLE BAG HAVING FACEPLATES

RELATED APPLICATIONS

This application is a continuation of U.S. patent application Ser. No. 14/008,916, filed Jan. 17, 2014, which is a national phase application of PCT Application No. PCT/US2012/0031373, filed Mar. 30, 2012, which claims the benefit of U.S. Provisional Application No. 61/516,346, filed Apr. 1, 2011, U.S. Provisional Application No. 61/574,352, filed Aug. 1, 2011 and U.S. Provisional Application No. 61/628,740, filed Nov. 4, 2011. The entire contents of those applications are incorporated herein by reference.

FIELD OF THE INVENTION

The disclosure relates generally to a configurable bag having multiple configurations such as a backpack, a saddlebag, and a messenger bag and more particularly to a bag having an interchangeable faceplate.

BACKGROUND OF THE INVENTION

Conventional bags, such as backpacks, often include multiple compartments and pockets for storing items. This configuration is often cumbersome, particularly when a user is not utilizing all or part of the storage space. This configuration can also be inconvenient if a user is riding a bicycle or needs to carry the bag in a manner other than using two straps often associated with backpacks. This arrangement may also be inconvenient if the user needs to quickly access an item in one of the storage compartments, causing the user to remove the backpack to access the internal space of the storage compartments.

One means of addressing the unused space is to have a collapsible bag. There are a variety of bags that convert from one configuration to another, such as from a backpack to a briefcase, but these bags are often bulky and include unused straps or handles that are bulky or dangerously exposed in the alternative configuration. For example, if the bag is used near a bicycle, the unused straps or handles could come into contact with the bike chain and/or wheels.

One means of converting conventional bags from a first configuration, such as a backpack, to a second configuration, such as a handbag, includes converting the strap of the bag with a zipper, but not converting the appearance of the storage compartments. This also limits the function of the compartments because the only change is from one strap to two straps by widening the straps and how they are placed on a user without also changing the storage capability of the bag.

Accordingly, a need exists for a configurable bag that can accommodate multiple configurations while using the straps provided and allowing a user to access storage compartments while traveling with the bag.

SUMMARY OF THE INVENTION

Disclosed is a configurable bag having a main bag compartment defined by a foldable bag body configurable between at least a first configuration and a second configuration via a folding of the bag body. The main bag compartment is accessible via a closable opening disposed in the foldable bag body when in the first configuration. The first and second securing means are affixed to the bag body, wherein the first and second securing means are disposed out of position for connection when the bag body is in the first configuration. The first and second securing means are positioned for connection via the folding of the bag body into the second configuration. The first and second securing means are configured to the bag body in the second configuration when the first securing means is secured to the second securing means.

Further disclosed is a configurable bag having a first configuration with a main compartment having a front panel, a back panel, a first side, and a second side. The bag further includes first and second storage compartments adjacent the front panel. A first closure means is disposed around the main compartment. First and second straps are attached to the back panel and extend between a top and a bottom of the back panel. Each of the straps includes first and second ends and is removably connected to the back panel with a first connecting means disposed at the first end of the first strap and a second connecting means disposed at the second end of the second strap.

Also disclosed is a configurable bag having a first configuration with a main compartment having a front panel, a back panel, a first side, and a second side. The bag further includes a first side panel adjacent the first side and disposed along a longitudinal axis of the main compartment and a second side panel adjacent the second side and disposed along a longitudinal axis of the main compartment, wherein each of the side panels includes an attachment means extending along an exterior surface thereof such that when one of the first and second panels is attached to the other of the first and second panels, the main compartment is compressed therebetween. First and second straps are attached to the back panel and extend between a top and bottom of the back panel. Each of the straps includes first and second ends and is removably connected to the back panel with a first connecting means disposed at the first end of the first strap and a second connecting means disposed at the second end of the second strap.

Further disclosed is a configurable bag having a first configuration wherein first and second straps attached to the back panel extend between a top and bottom of the back panel; each of the straps has first and second ends and is removably connected to the back panel with a first connecting means disposed at the first end of the first strap and a second connecting means disposed at the second end of the second strap; first side panel is disposed adjacent the first side and second side panel is disposed adjacent the second side, each of the panels being disposed along the longitudinal axis of the main compartment, and at least one of the side panels is configured to engage the other of the side panels.

Also disclosed is a configurable bag having a second configuration wherein a first side panel engages a second side panel via an attachment means; and a first connecting means disposed at the first end of the first strap engages a second connecting means disposed at the second end of the second strap, each of the storage compartments being disposed on opposite sides of the configurable bag; and a third configuration wherein the configurable bag is attached to a bicycle, wherein the attachment means is disposed around the bicycle such that the first storage compartment and second storage compartment are disposed on first and second sides of a bicycle, respectively.

Further disclosed is a configurable bag having a belt compartment with first and second ends, a connection means disposed at each of the first and second ends, a front panel and a back panel; first and second straps disposed on the front panel and extending along a length thereof; a first storage compartment connected to the front panel, the first storage compartment having a first attachment means disposed thereon for engaging at least one of the first and second straps; and a second storage compartment adjacent the first storage compartment and connected to the front panel, the second storage compartment having a second attachment means disposed thereon for engaging at least one of the first and second straps.

BRIEF DESCRIPTION OF THE FIGURES

The following descriptions should not be considered limiting in any way. With reference to the accompanying drawings, like elements are numbered alike.

DETAILED DESCRIPTION

Figure 1:
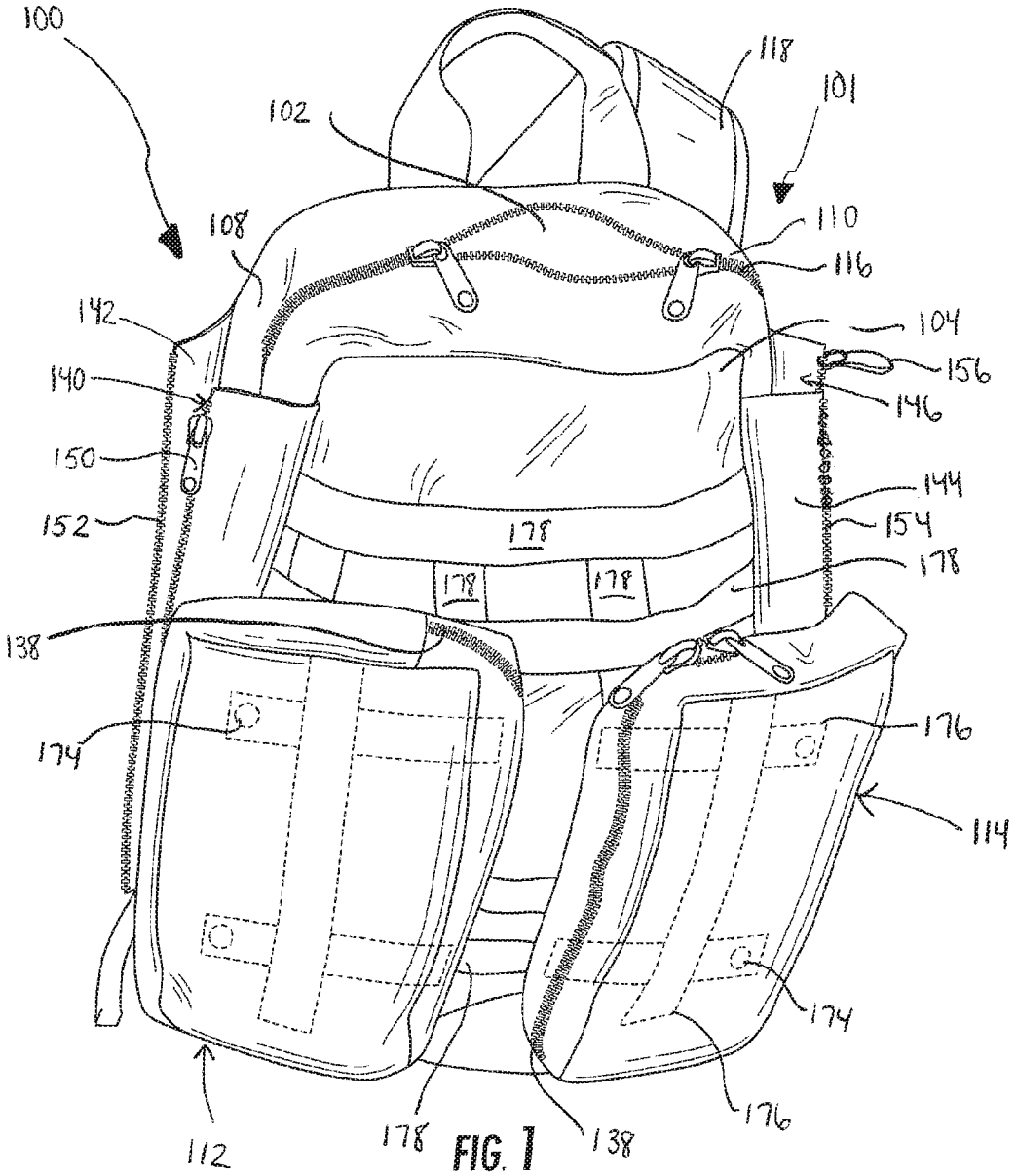
FIG. 1 is a front perspective view of a configurable bag in a first configuration.
Figure 2:
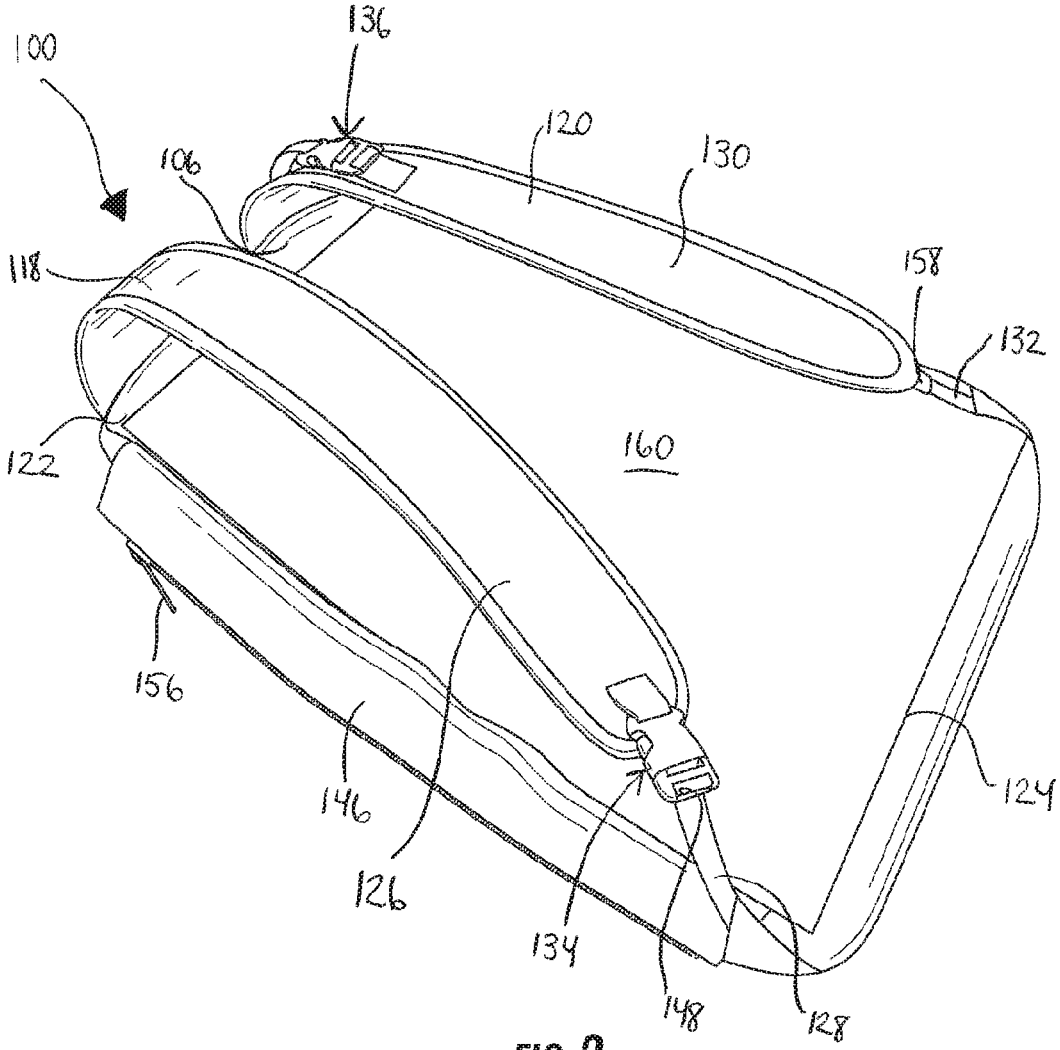
FIG. 2 is a rear perspective view of the configurable bag in the first configuration.
Figure 3:
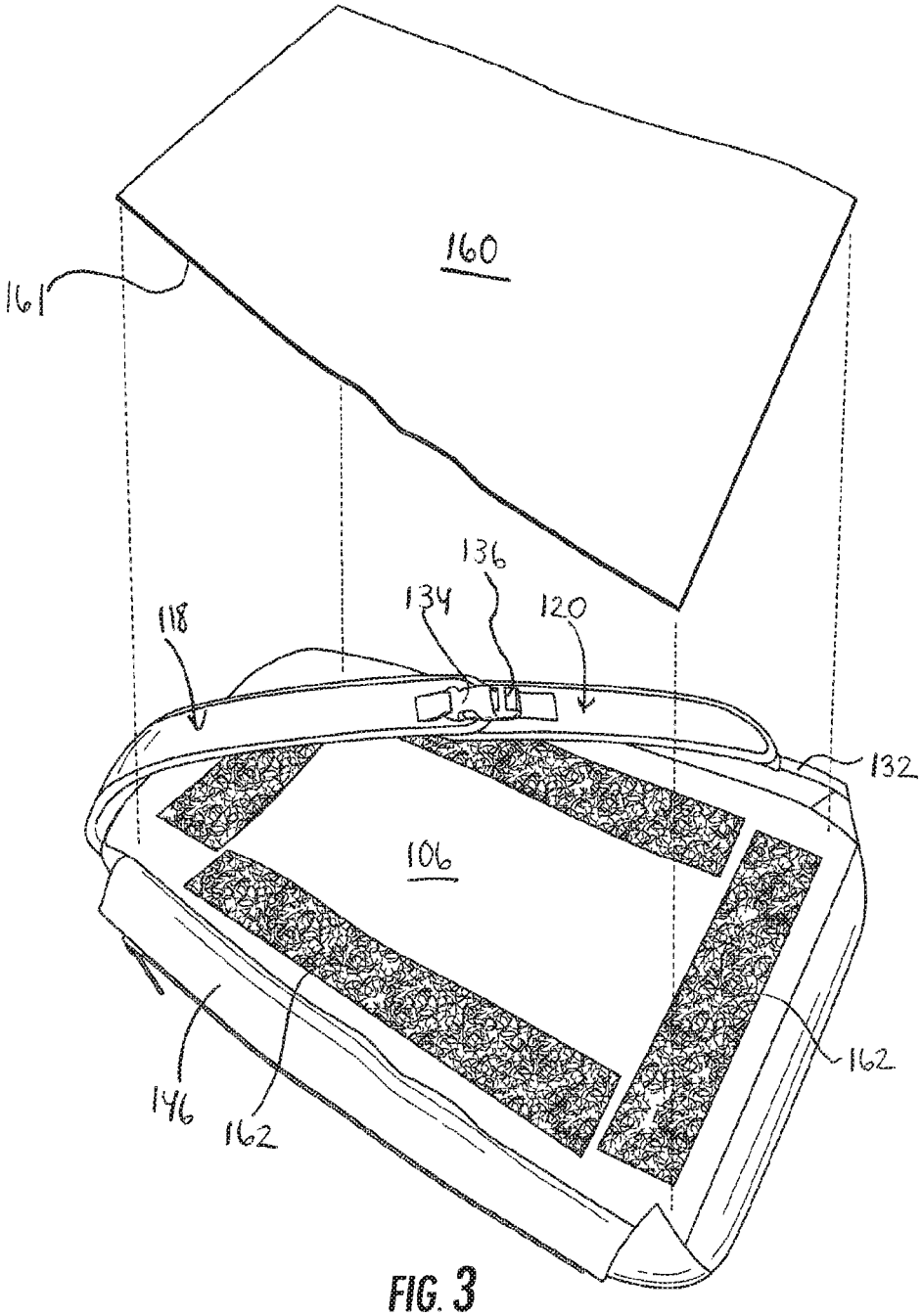
FIG. 3 is a rear, exploded view of the configurable bag with the cover removed.
Figure 16:
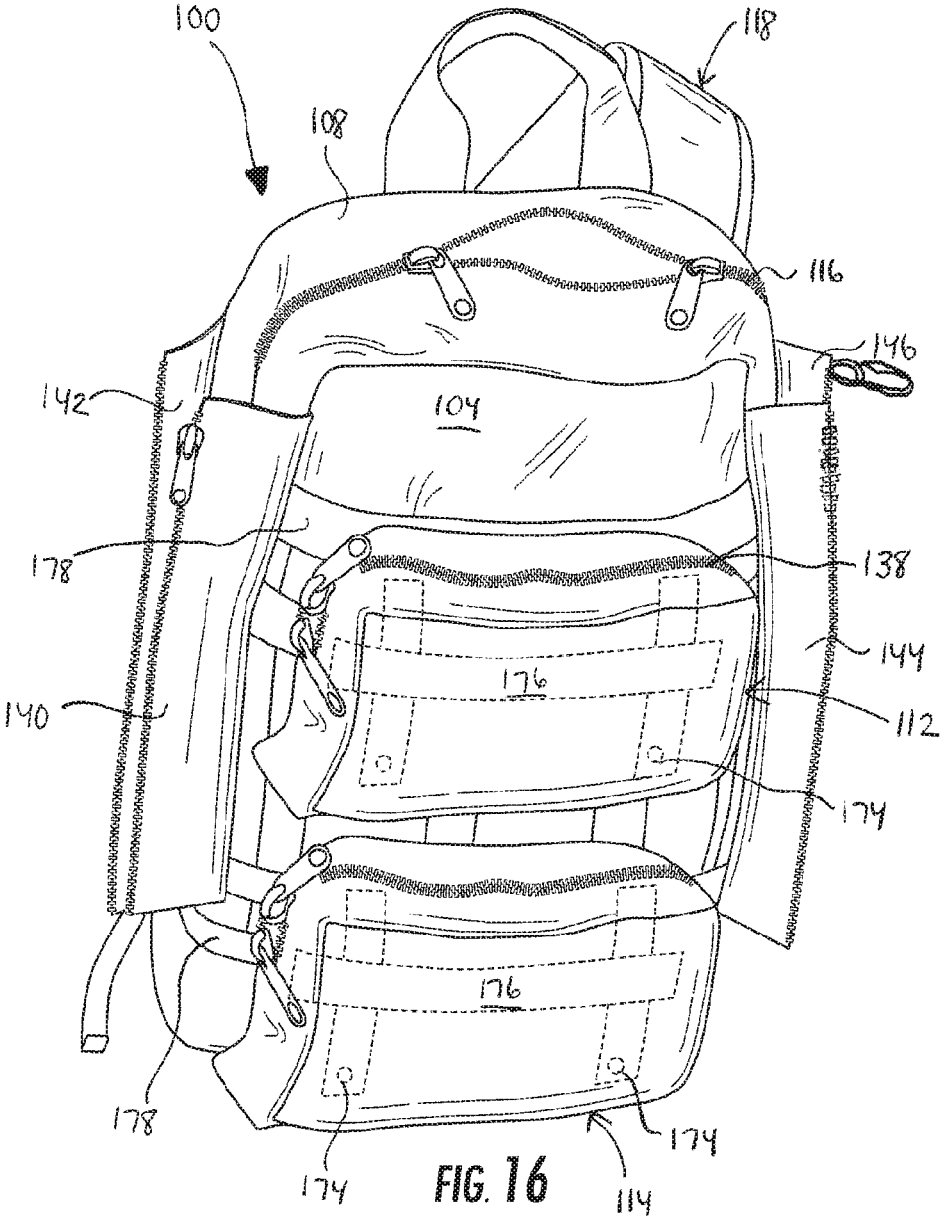
FIG. 16 is a front perspective view of the configurable bag in the first configuration with first and second storage compartments attached horizontally.

Referring to FIGS. 1-3, an exemplary embodiment of a configurable bag 100 in a first configuration is illustrated. In this exemplary embodiment, the bag 100 is a backpack and includes a main compartment 102 with a front panel 104 and a back panel 106. The bag 100 is made of a collapsible material such that various sections can be compressed and expanded depending on the intended use. The bag 100 is further defined by a first side 108 and an opposing second side 110, both extending along the longitudinal axis thereof. The front panel 104 includes a first storage compartment 112 attached thereto as well as a second storage compartment 114 attached adjacent the first storage compartment 112. As seen in FIG. 1, the storage compartments 112, 114 are aligned vertically, and disposed parallel to the longitudinal axis of the bag. Turning to FIG. 16, the storage compartments 112, 114 can be arranged horizontally, and disposed perpendicular to the longitudinal axis of the bag, such that the first compartment 112 is disposed above the second storage compartment 114. The main compartment 102 is secured by a first closure means 116 such as a zipper or related device extending around at least a portion of the exterior surface thereof for securely closing the main compartment 102. Each of the first and second storage compartments 112, 114 is secured by a second closure means 138, such as a zipper, extending around at least a portion of the exterior surface thereof.

Turning to FIGS. 2 and 3, the back panel 106 of the bag includes first strap 118 and second strap 120 attached thereto. The straps 118, 120 extend between the top 122 and bottom 124 of the back panel 106. Preferably, the straps 118, 120 include padding or are made from a padded material such as to add comfort to a user when carrying the bag and when the interior components of the compartments 102, 112, 114 include heavier items that would add pressure to the user's shoulders. As seen in FIG. 2, the first strap 118 includes a first end 126 and a second end 128. The first end 126 is fixed to the top 122 of the back panel 106 and the second end 128 is adjacent the bottom 124 of the back panel 106. The second end 128 is further defined by a first connecting means 134. The connecting means 134, in this embodiment, is a buckle, but can be any related or suitable device for securing the strap 118. The second end 128 further includes a first adjustment means 148.

The first adjustment means 148 can be in the form of a buckle and a strap or related measure of adjusting the distance between the strap 118 and the back panel 106 to accommodate the user's comfort. A second adjustment means 158 can also be in the form of a buckle and a strap or related measure of adjusting the distance between the second strap 120 and the back panel 106. The second adjustment means 158 is fixed to the back panel 106. The first end 128 of the first strap 118 is configured to mate with the first adjustment means 148. The second end 132 of the second strap 120 is configured to mate with the second adjustment means 158. For example, if the connecting means 134 is a buckle, then the adjustment means 148 is received in the buckle 134 and adjusted thereto to accommodate the user's comfort, increasing or decreasing the distance between the strap 118 and the back panel 106.

Figure 4:
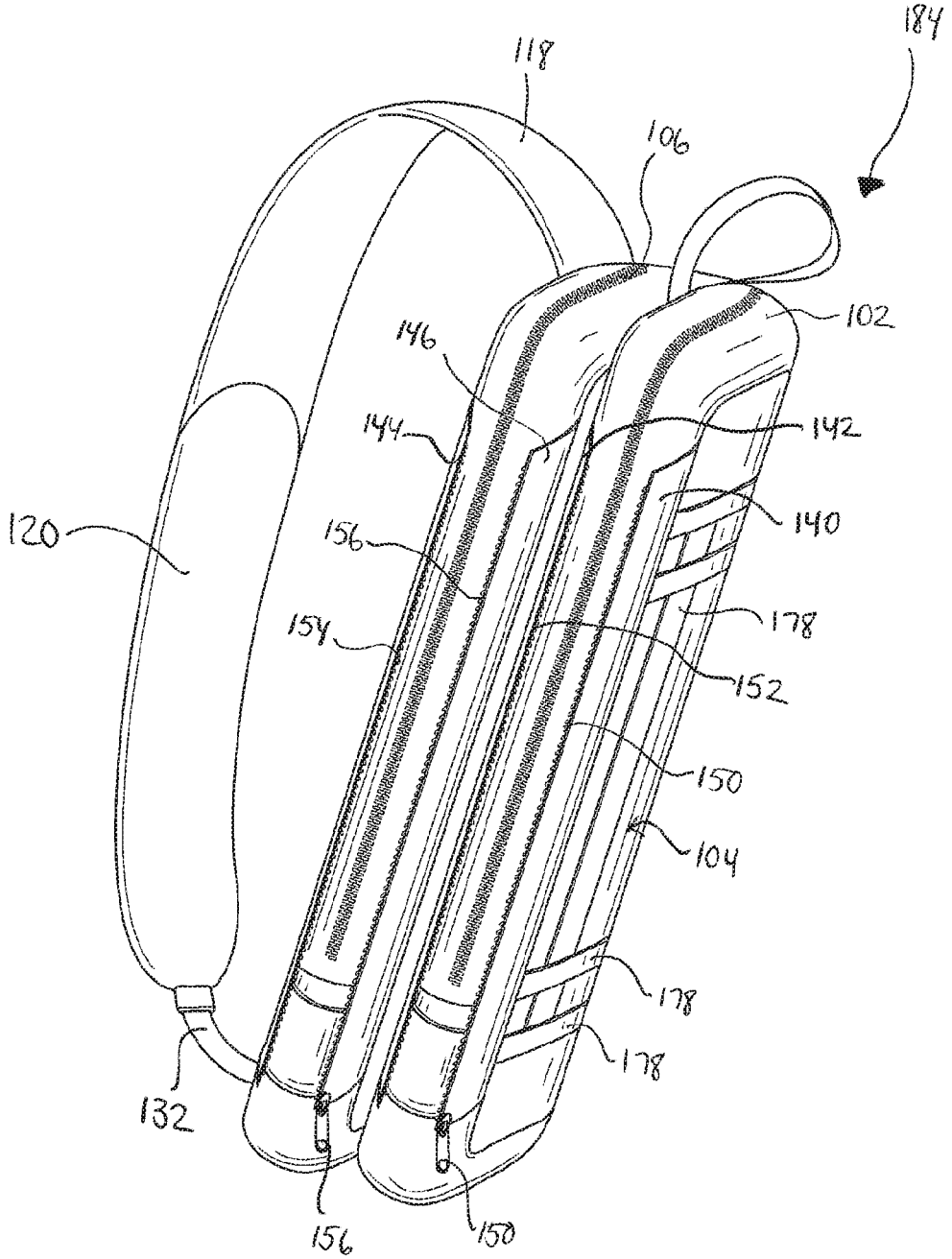
FIG. 4 is a front perspective view of the configurable bag in a second configuration with the side panels disengaged.
Figure 5:
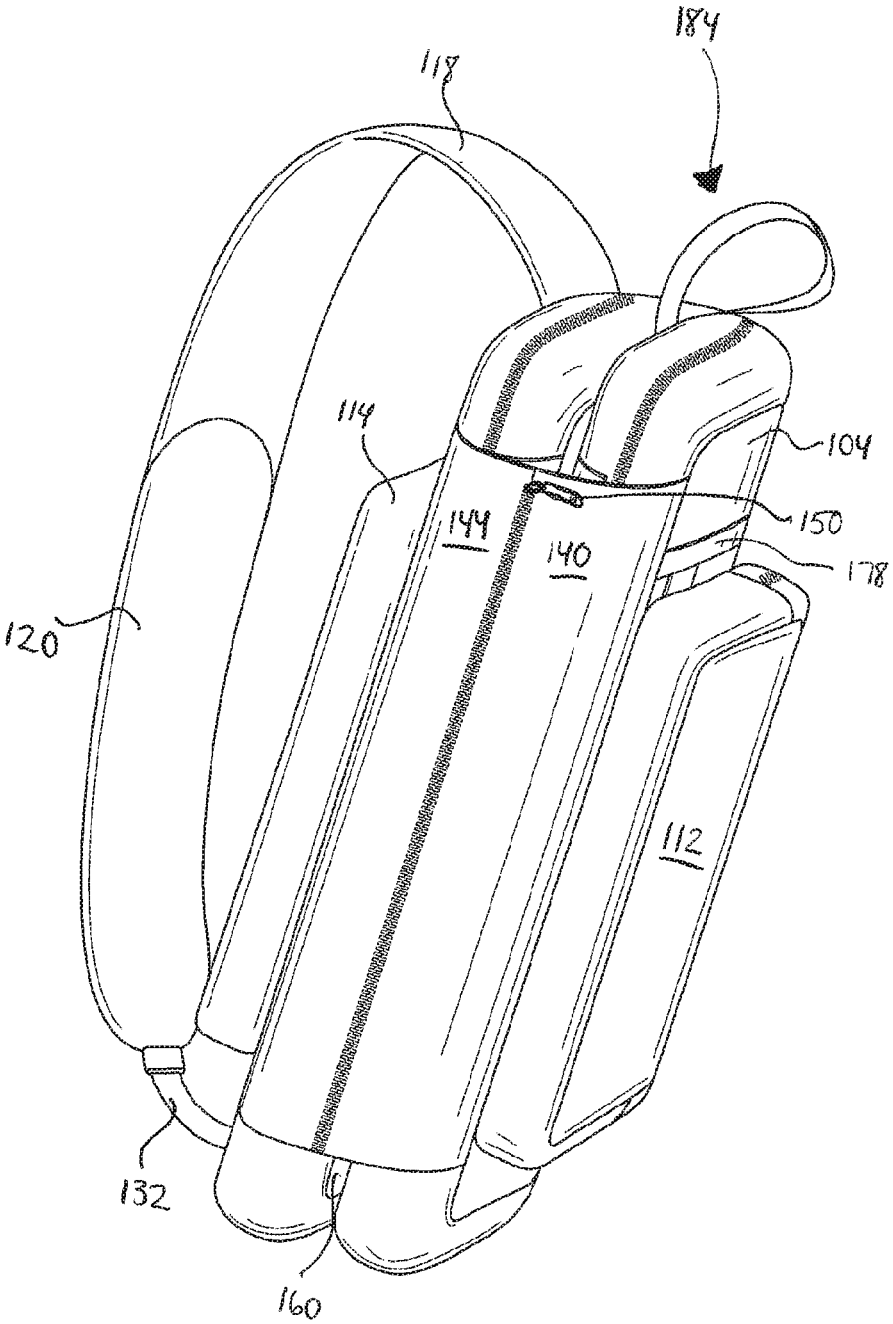
FIG. 5 is a front perspective view of the configurable bag in the second configuration with the side panels engaged.

The configurable bag 100 further includes side panels extending along the longitudinal axis of the main compartment 102. As seen in FIGS. 1, 4, and 5, first side 108 includes first side panel 140 and second side panel 142 adjacent thereto and extending between the top and bottom of the bag. The second side 110 includes third side panel 144 and fourth side panel 146 adjacent thereto and extending between the top and bottom of the bag. The panels 140, 142, 144, 146 can be made of any material sturdy enough to withstand normal wear and tear, but flexible enough to fold around the bag when the bag is compressed. In this embodiment, the side panels 140, 142, 144, 146 are substantially rectangular and are permanently attached to the main compartment 102 of the bag 100. Each of the side panels 140, 142, 144, 146 includes an attachment means 150, 152, 154, 156, respectively, extending along an exterior surface thereof. As such, each of the panels can be attached to any one of the other panels. When one of the panels is attached to another panel, the main compartment 102 is compressed therebetween.

The panels can be used to compress the main compartment 102 between adjacent panels or to convert the bag 102 from the first configuration 100 to the second configuration 184. As seen in FIG. 5, first panel 140 is attached to third panel 144 by connecting attachment means 150 with attachment means 154 and the main compartment 102 is compressed therebetween. Preferably, one of the first and second panels 140, 142 is attached to one of the third and fourth panels 144, 146 and the main compartment 102 is compressed therebetween to reduce the carrying capacity of the bag 100 and allow for a user to carry the bag in a different configuration. When at least one of the first and second panels 140, 142 is attached to one of the third and fourth panels 144, 146 such that the main compartment 102 is folded therebetween, the first storage compartment 112 and the second storage compartment 114 are disposed on opposite sides thereof such that the bag resembles the second configuration 184.

In the illustrated embodiment, all of the disclosed attachment means 150, 152, 154, 156 are zippers disposed along the exterior surface of the side panels 140, 142, 144, 146, respectively, for providing a secure and easily accessible connection between the side panels 140, 142, 144, 146. Other attachment means can be used such as snaps, hook and loop closures, or the like.

Turning to FIGS. 2 and 3, the back panel 106 of the bag 100 includes a cover or faceplate 160. The faceplate 160 preferably extends along at least a portion of the back panel 106 and preferably, along the entire surface of the back panel 106. The faceplate 160 is removably attached to the back panel 106 with a cover attachment means 162 such as a hook and loop closure as illustrated in FIG. 3. As seen in FIG. 3, the cover attachment means 162 is arranged in a plurality of strips disposed along the perimeter of the back panel 106. If the hooks are disposed on the back panel 106, then the corresponding loops are disposed in a similar arrangement on the interior 161 of the faceplate 160. The cover attachment means 162 could also include a zipper, a plurality of snaps, or the like. In this embodiment, the faceplate 160 is substantially rectangular shaped to extend across the entire back panel 106. Both the back panel 106 and the faceplate 160 can have alternative shapes so long as the faceplate 160 is removably attached to the back panel 106.

Although not illustrated, the faceplate 160 can include a variety of artistic designs displayed thereon. Thus, a user could interchange the faceplate having a first artistic design with a faceplate having an alternative and second artistic design. Thus, the user could interchange the faceplate to reflect their style or design preference. The connection means 162 makes this interchangeability possible because the faceplate 160 can be quickly and securely removed and reattached to the back panel 106. The interchangeable faceplate would also have a corresponding attachment means such as a plurality of loops arranged on the interior of the faceplate. The material of the faceplate 160 could be similar to that of the back panel 106 or an alternative material to reflect the artistic style and preference of the user.

Figure 6:
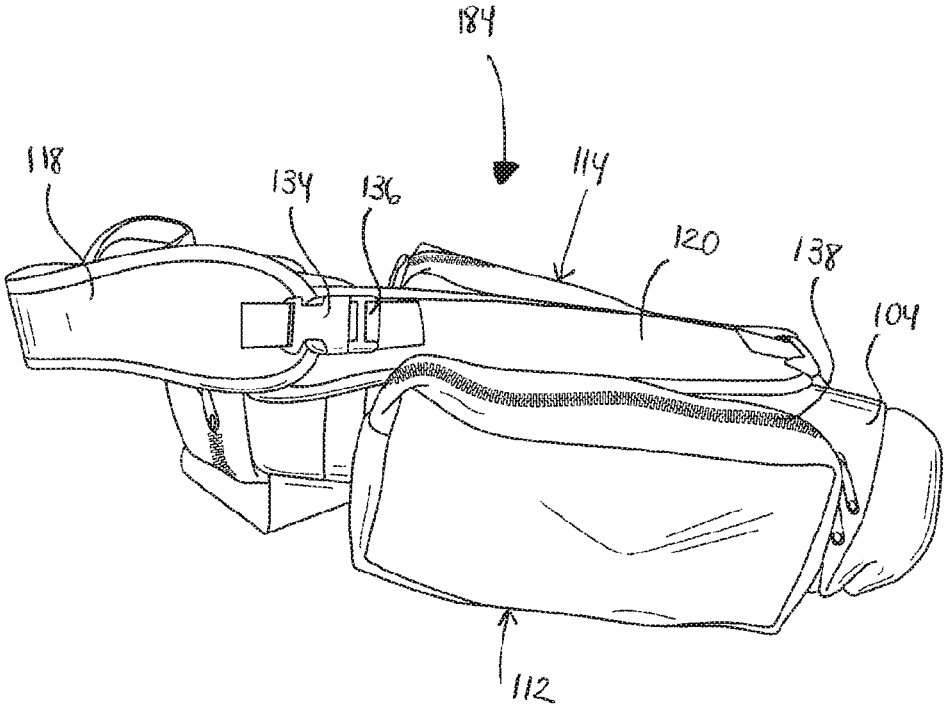
FIG. 6 is a side perspective view of the configurable bag in the second configuration with the first strap attached to the second strap.

To convert the bag 100 from the first configuration to the second configuration, as seen in FIG. 6, the first connecting means 134 is detached at the first strap 118 and the second connecting means 136 is detached at the second strap 120. Each of the straps is rotated around the main compartment 102 and reattached to the opposite strap. In other words, the first end 126 and the second end 128 of the first strap 118 are separated by disengaging the first connecting means 134. Similarly, the first end 130 and the second end 132 of the second strap 120 are separated by the second connecting means 136. Preferably, the first end 126 of the first strap 118 is rotated around the main compartment 102 and connected to the second end 128 of the second strap 120 by mating the first connecting means 134 with the second connecting means 136. The main compartment 102 is compressed therebetween and the side panels are connected. Preferably, as seen in FIG. 5, first panel 140 is connected to third panel 144 and secured by connecting attachment means 150 to attachment means 154. The remaining panels 142, 146 will be compressed therebetween. In the second configuration 184, the first and second storage compartments 112, 114 are disposed on opposite sides of the resulting bag 184.

Figure 7:
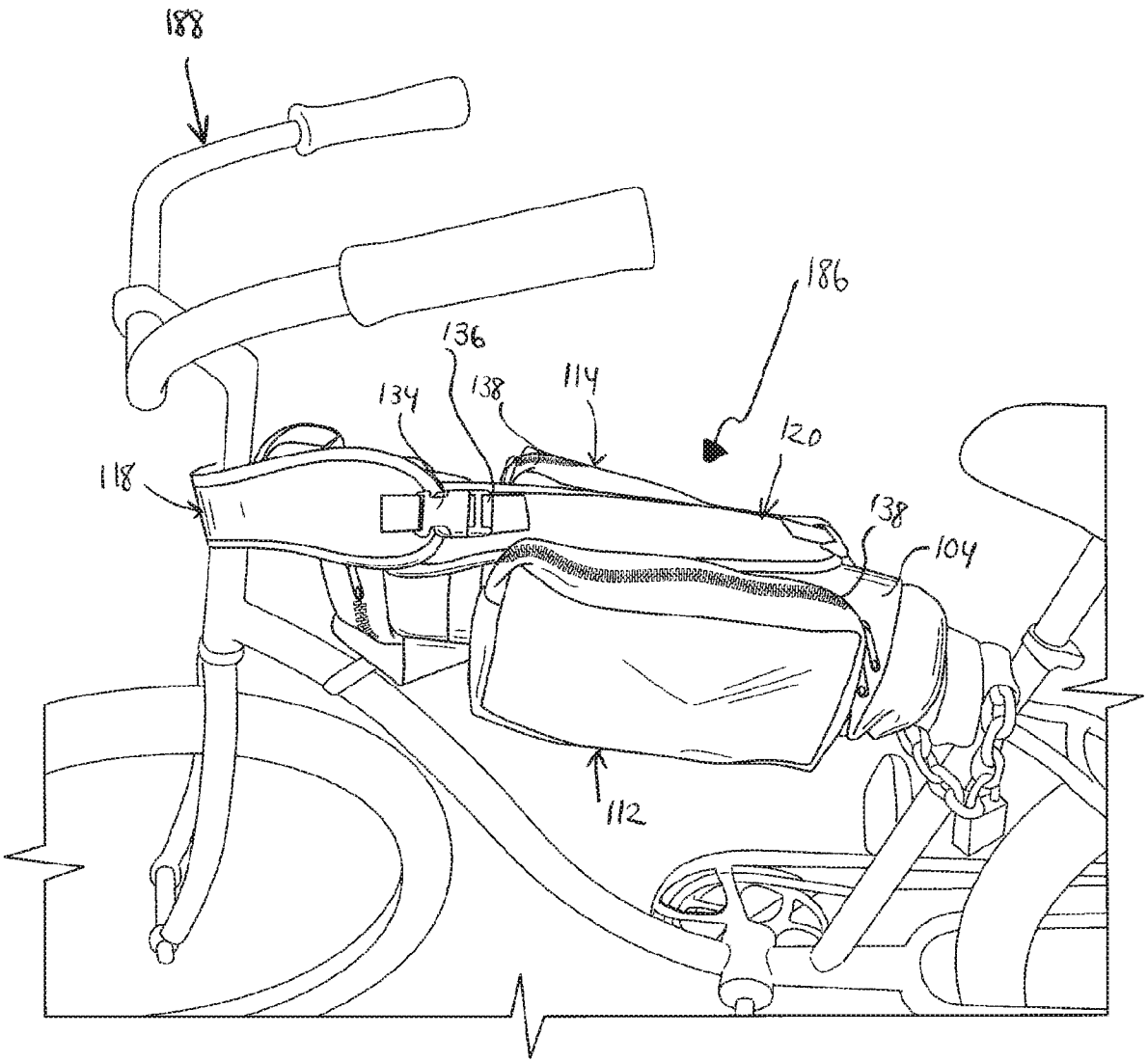
FIG. 7 is a side perspective view of the configurable bag in a third configuration.
Figure 8:
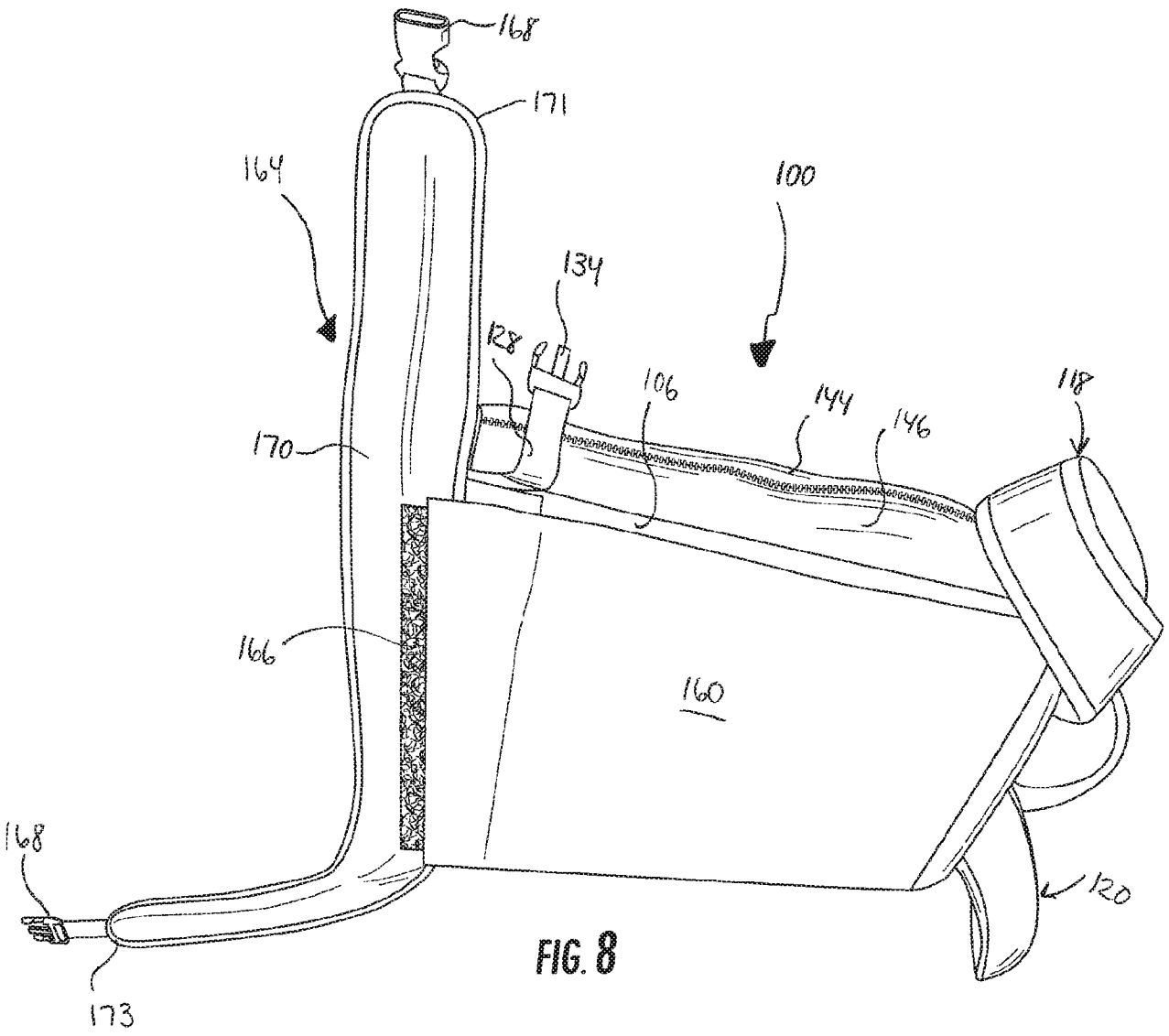
FIG. 8 is a rear perspective view of the configurable bag in the first configuration with a belt compartment.
Figure 9:
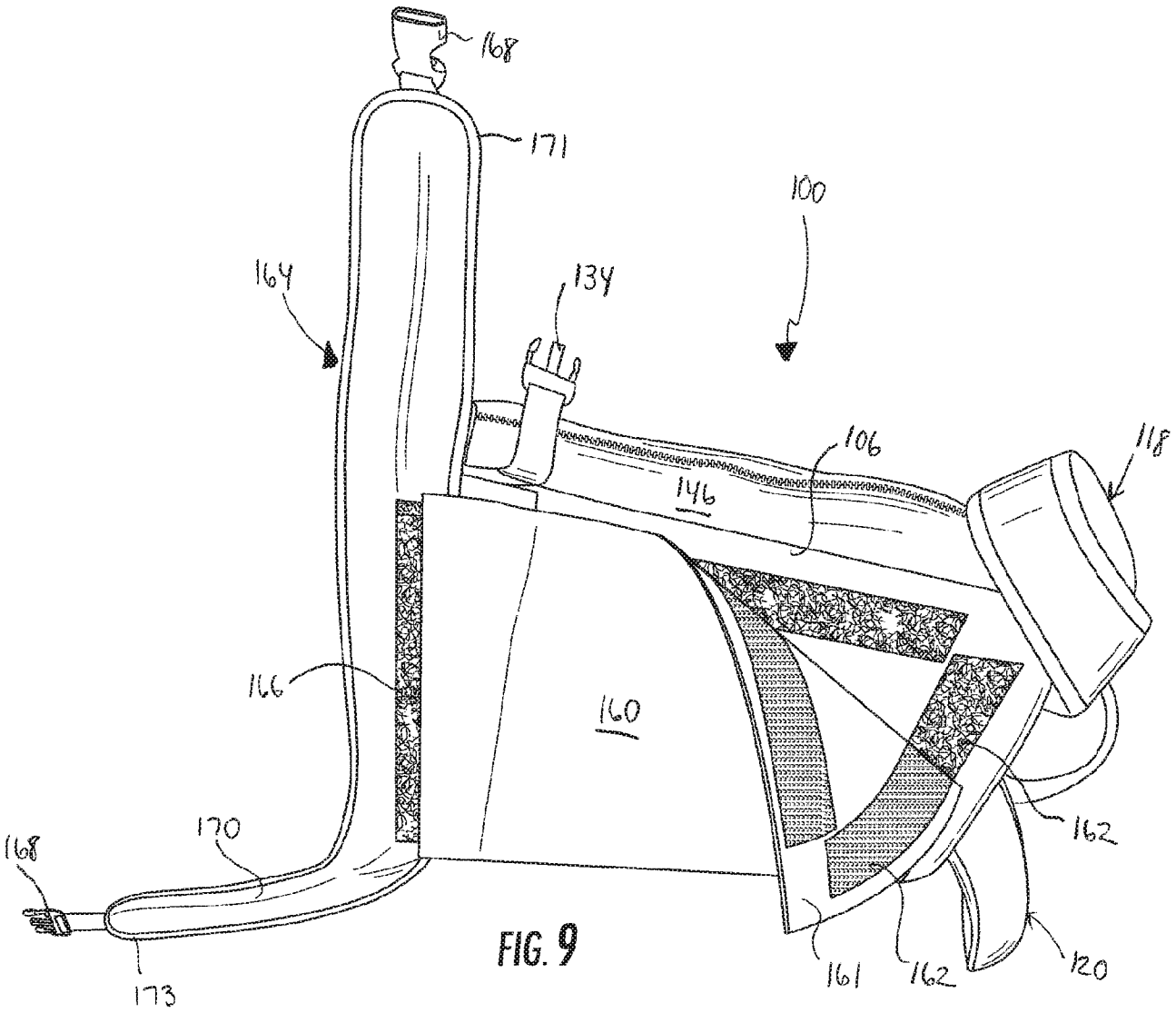
FIG. 9 is a rear perspective view of the configurable bag in the first configuration with the belt compartment and the cover partially removed.
Figure 10:
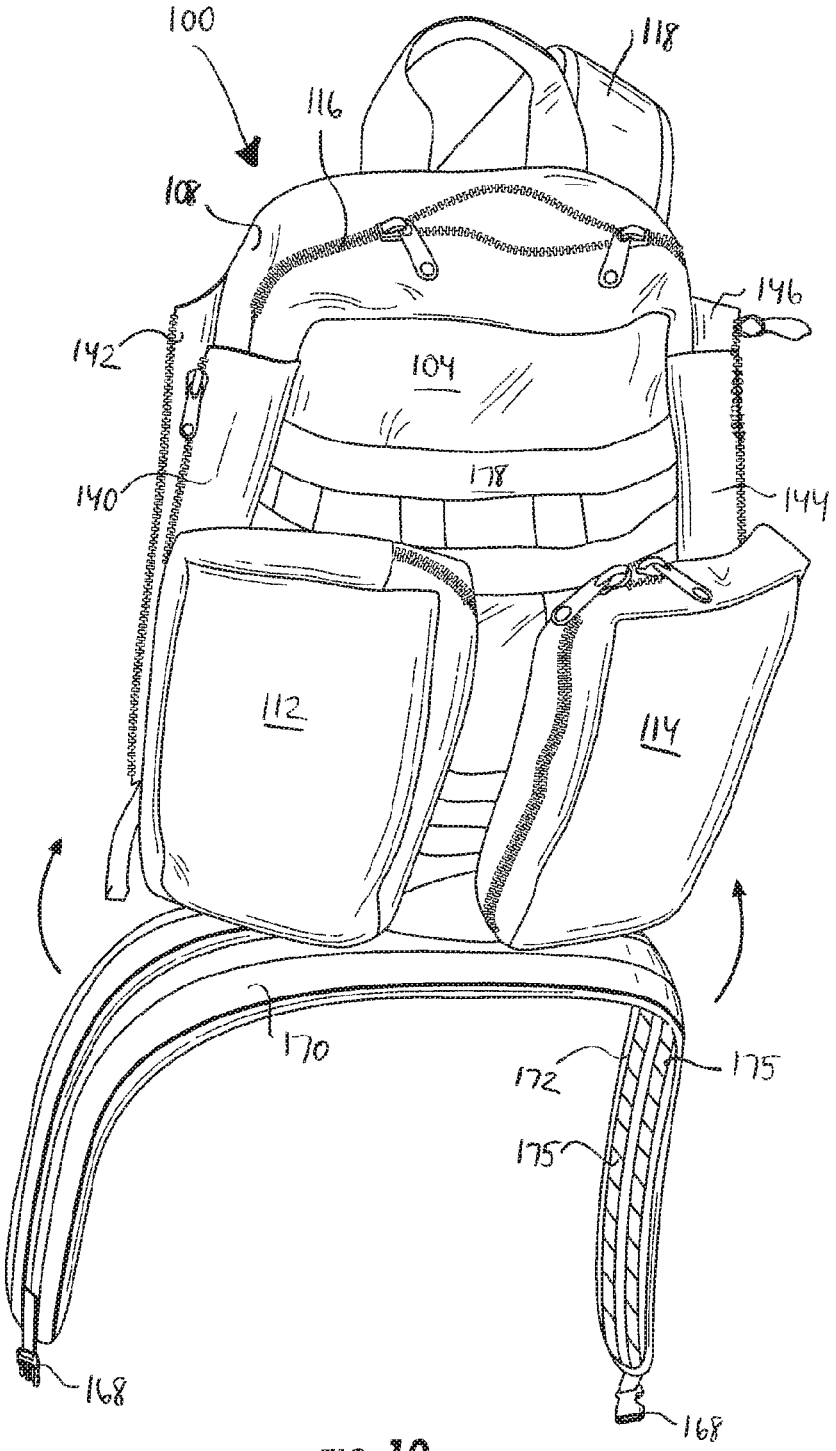
FIG. 10 is a front perspective view of the configurable bag in the first configuration with the belt compartment.
Figure 11:
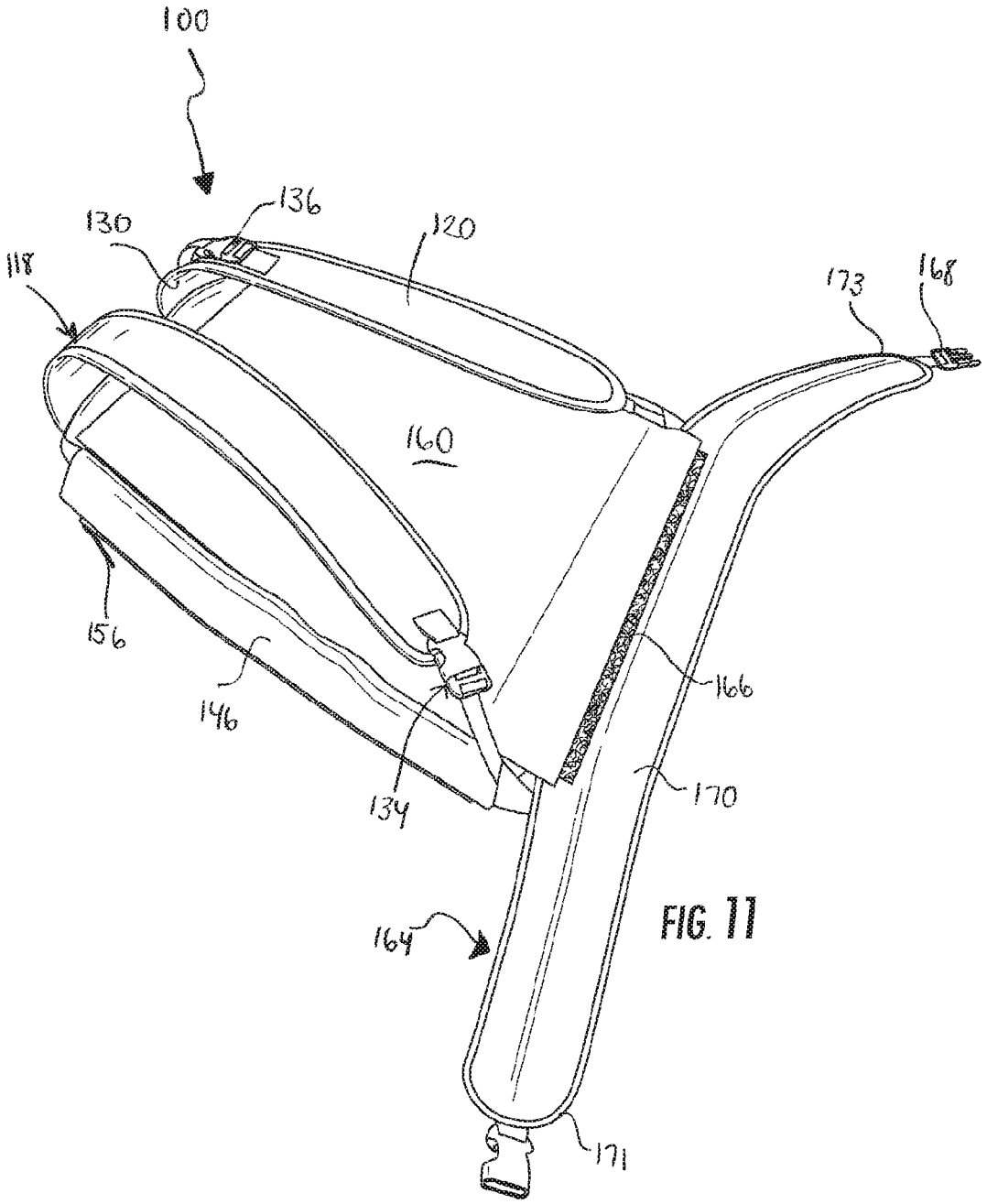
FIG. 11 is a rear perspective view of the configurable bag in the first configuration with the belt compartment and the straps attached.

To convert the bag from the first or second configuration to the third configuration 186, as seen in FIG. 7, the bag 100 is attached to a bicycle 188, thus forming a saddle configuration 186. The first strap 118 and second strap 120 are connected as in the second configuration 184, but rather than securing the straps 118, 120 around a user, the straps 118, 120 are wrapped around the bicycle 188. As seen in FIG. 7, first storage compartment 112 and second storage compartment 114 are disposed on opposite sides of the bike 188 for optimal balancing needs and to provide access to the user.

Referring to FIGS. 8-14, an optional attachment to the bag 100 is a belt 164 attached to the back panel 106 with a belt attachment means 166. Preferably, the belt attachment means 166 includes a flap extending towards the bag 100 and having a hook and loop closure such that the first side 170 of the belt 164 includes a plurality of hooks and the second side 172 of the belt 164 includes a plurality of loop closures. With this configuration, the belt 164 would be sandwiched between the faceplate 160 and the back panel 106. Thus, the hooks on the first side 170 would attach to the underside of the faceplate 160 and the loop closures on the second side 172 would attach to the back panel 106. The belt attachment means 166 could also be in the form of a zipper, a plurality of snaps, or the like.

The belt 164 further includes a belt connection means for securing the belt 164 to a user's waist or to a bicycle 186. Specifically, the belt connection means 168 is partially disposed at first end 171 and second end 173 to secure the first end 171 to the second end 173. In the illustrated embodiment, the belt connection means 168 is in the form of a buckle 168. As such, the first end 171 engages the second end 173 to secure the buckle 168.

Figure 12:
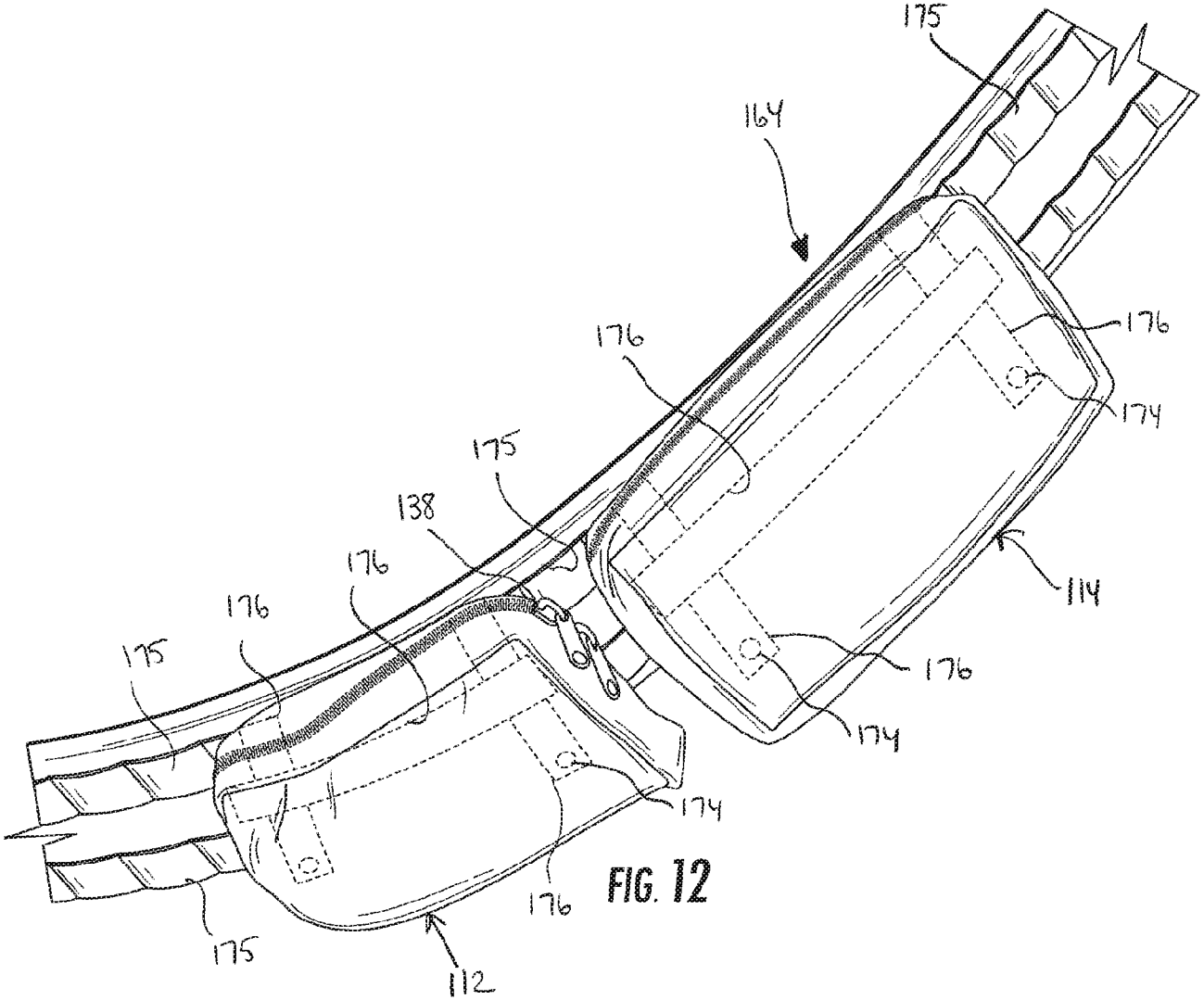
FIG. 12 is a front perspective view of the belt compartment with first and second storage compartments attached thereto.
Figure 13:
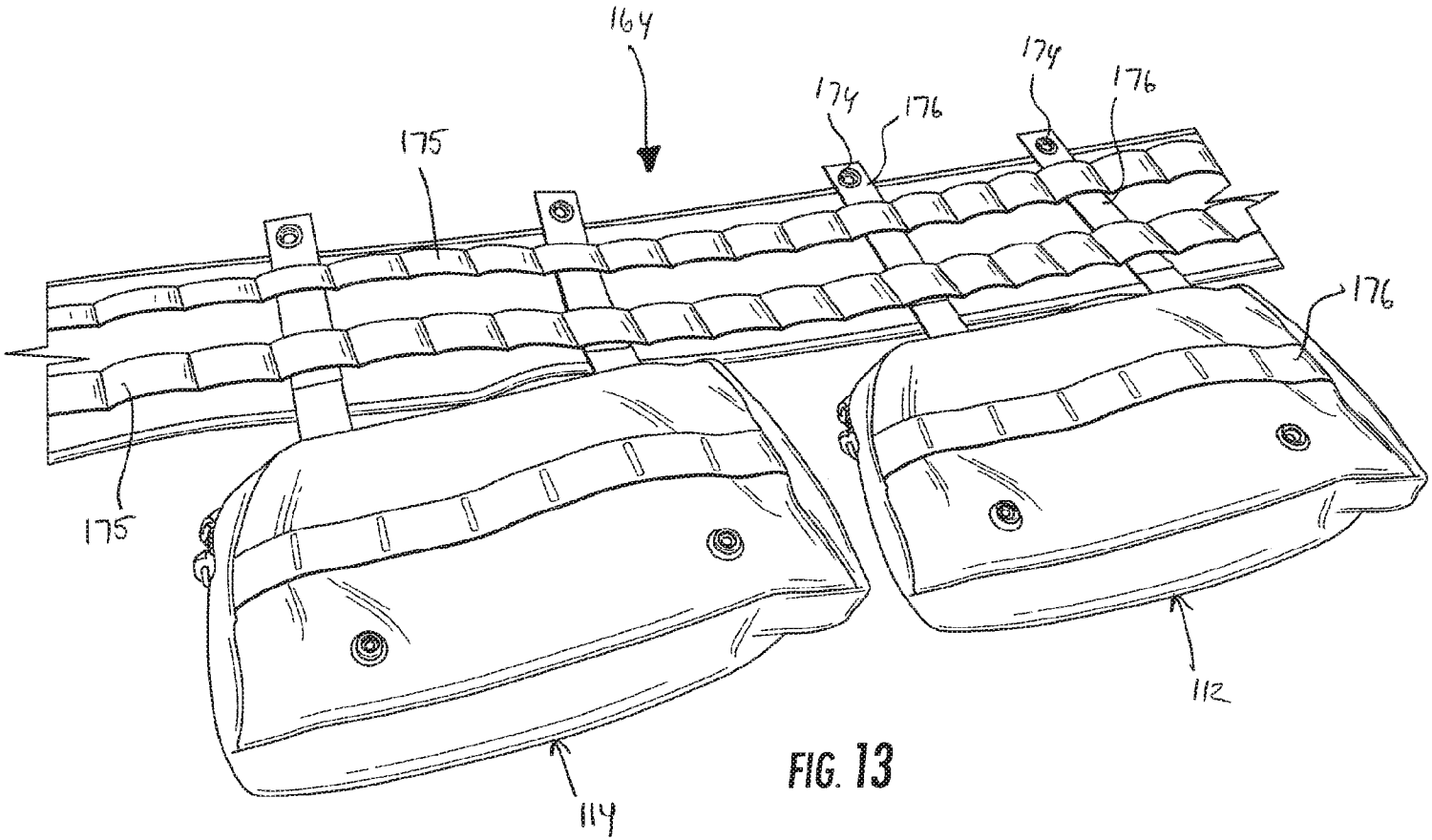
FIG. 13 is a front perspective view of the belt compartment with first and second storage compartments partially detached therefrom.
Figure 14:
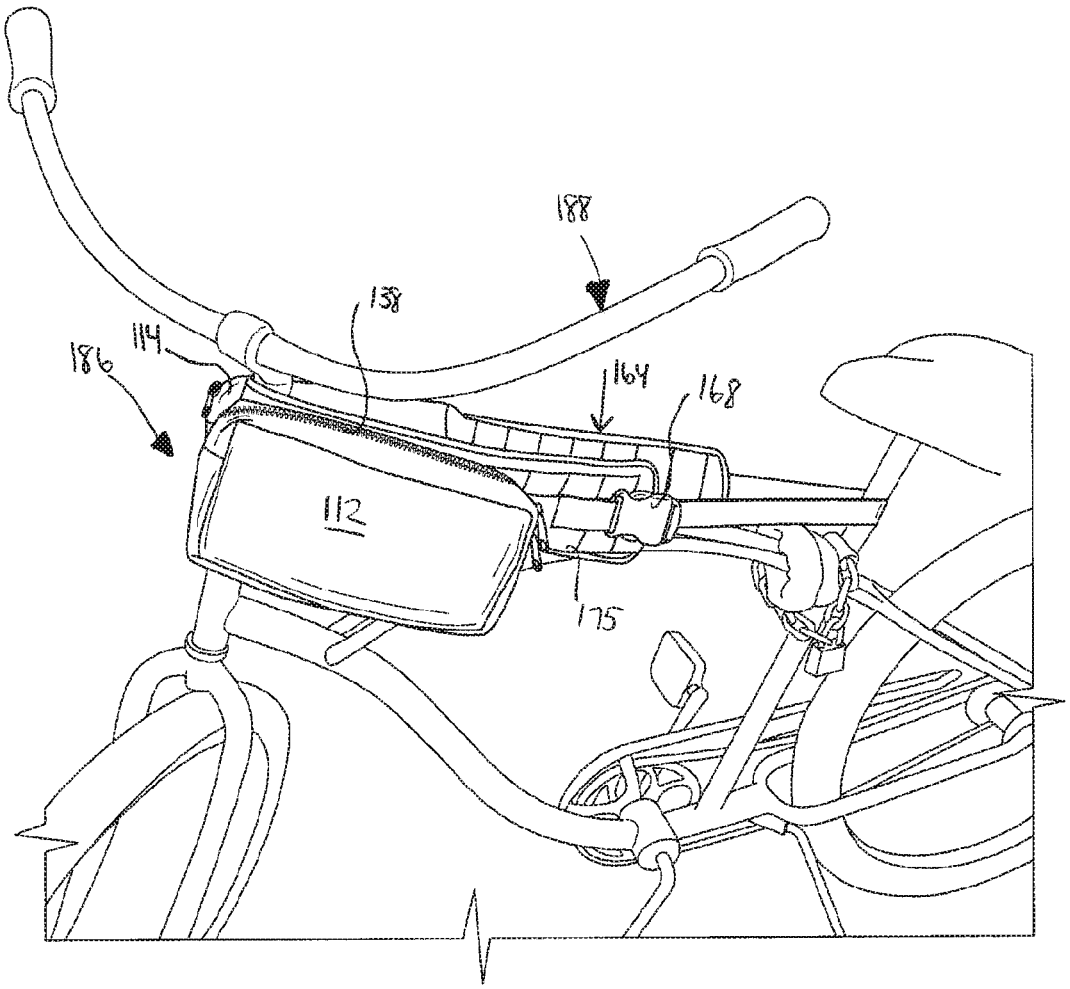
FIG. 14 is a side perspective view of the belt compartment in a saddle configuration.

As seen in FIGS. 12-14, the belt 164 may be worn separately from the bag 100 and used similarly by attaching the first and second storage compartments 112, 114 thereto. As such, the belt 164 includes a first plurality of straps 175 on the exterior and second side 172 facing the back panel 106. The plurality of woven straps 175 receives a second plurality of straps 176 disposed on the storage compartments 112, 114. Turning to FIG. 13, the storage compartments 112, 114 each include straps 176 that are woven through the straps 175 of the belt 164 and secured by an attachment means 174 such as a snap 174 having a mating end on the storage compartments 112, 114 and the plurality of straps 174. The storage compartments 112, 114 are secured to the belt 164 accordingly.

An additional feature of the bag 100 is the ability to arrange the storage compartments 112, 114 in a vertical or horizontal orientation. Turning to FIG. 1, the storage compartments 112, 114 are disposed vertically with respect to the longitudinal axis of the bag 100. As seen in FIG. 16, the storage compartments 112, 114 are disposed horizontally with respect to the longitudinal axis of the bag. This is accomplished with the plurality of straps 176 and the attachment means 174 disposed on the interior surface of the storage compartments 112, 114. The plurality of woven straps 178 on the front panel 104 are preferably arranged in a vertical and horizontal pattern to create a woven or webbed pattern. The straps 176 of the first and second storage compartments 112, 114 are then received by and interwoven with the plurality of straps 178 disposed on the front panel 104 of the bag 100, as seen in FIGS. 15 and 16.

Figure 15:
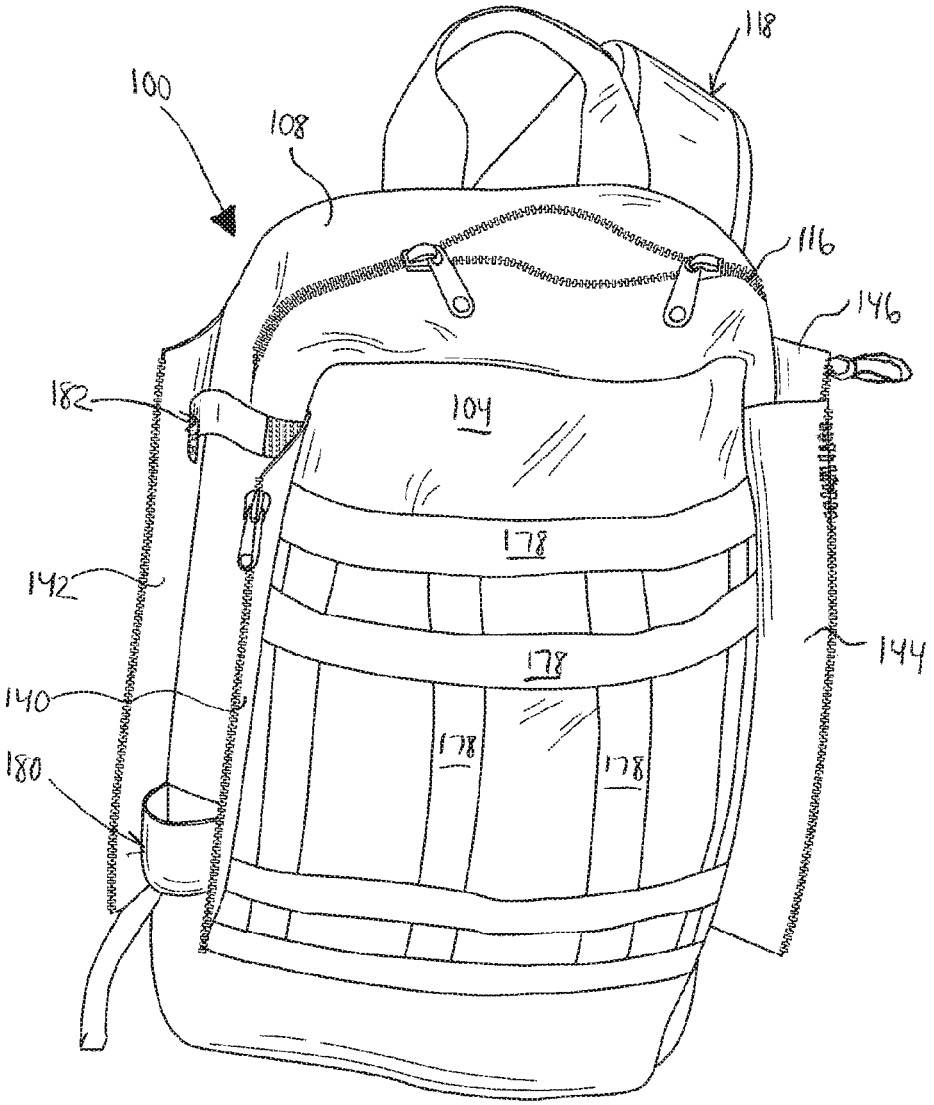
FIG. 15 is a front perspective view of the configurable bag in the first configuration without first and second storage compartments.

Referring to FIG. 15, the bag 100 includes an additional feature for the first configuration. At least one side 108 of the bag includes a pocket 180 towards the bottom of the bag 100 and located between first side panel 140 and second side panel 142. The pocket 180 has a closed bottom and an open top for receiving an umbrella, or similar object. Above the pocket 180 and disposed towards the first closure means 116, the bag further includes a strap 182 having a hook and loop configuration, or similar attachment means, towards the end of the strap 182. Preferably, the user would insert a first side of an umbrella, or similar object, into pocket 180 and secure the second side of the umbrella, or similar object, by wrapping strap 182 around the second side thereof. By engaging attachment means 150, 152 of first side panel 140 and second side panel 142, the umbrella, or similar object, is further secured to the bag 100.

While the invention has been described with reference to an exemplar) embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A configurable bag comprising:

a foldable bag body defining a main bag compartment that is accessible through a closable opening formed therein, said foldable bag body being configurable between at least a first configuration wherein said foldable bag body is substantially unfolded and a second configuration wherein said foldable bag body is folded upon itself to define a folded edge and an opposing edge, said foldable bag body comprising:

a front panel;

a back panel opposite said front panel and defining a cover attachment means disposed thereon;

a faceplate removably secured to said back panel through said cover attachment means;

a plurality of side panels each comprising an attachment means, wherein said attachment means associated with one of said plurality of side panels is individually engageable with said attachment means of a plurality of said plurality of side panels to provide selective connection therebetween; and a pair of convertible straps comprising:

a first strap having a top end fixedly secured to a relative top left end of said foldable bag body and a bottom end removably securable to a relative bottom left end of said foldable bag body; and a second strap having a bottom end fixedly secured to a relative bottom right end of said foldable bag body and a top end removably securable to one or the other of (i) a relative top right end of said foldable bag body and (ii) said bottom end of said first strap; and a plurality of storage compartments each removably attachable to said front panel and defining at least one closable opening formed therein, wherein each of said plurality of storage compartments are disposed on a single side of said foldable bag body while said foldable bag body is maintained in said first configuration, while at least two of said plurality of storage compartments are disposed on opposing sides of said foldable bag body while said foldable bag body is maintained in said second configuration through connection at said opposing edge between at least a pair of said plurality of side panels and corresponding ones of said attachment means to provide an overlap of at least one of a remainder of said plurality of side panels.

2. The configurable bag of claim 1, wherein said plurality of storage compartments define a first storage compartment and a second storage compartment.

3. The configurable bag of claim 2, wherein at least one of said first storage compartment and said second storage compartment is removably attached to said main bag compartment via at least one of a plurality of straps, a zipper, a hook and loop closure, and a first plurality of straps interwoven with a second plurality of straps, said second plurality of straps being disposed on said main bag compartment.

4. The configurable bag of claim 1, further including a first connector coupled at said bottom end of said first strap, and a second connector coupled at said top end of said second strap, said first connector removably securable to said second connector.

5. The configurable bag of claim 1, wherein said first strap and said second strap are secured to said relative top end and said relative bottom end of said bag body when in said first configuration, and secured to each other when in said second configuration.

6. The configurable bag of claim 1, wherein said first strap and said second strap extend from a relative back of said bag body when in said first configuration.

7. The configurable bag of claim 1, wherein said bag body is folded about a relative center thereof in said second configuration.

8. The configurable bag of claim 1, wherein said bag body is folded about a relative center to receive an object within said relative center.

9. The configurable bag as claimed in claim 8, wherein said object is a bike.

10. The configurable bag of claim 1, wherein said first configuration is a backpack.

11. The configurable bag of claim 1, wherein said second configuration is a messenger bag.

12. The configurable bag of claim 11, wherein said main bag compartment is closed and a first of said plurality of storage compartments is a primary storage unit.

13. The configurable bag of claim 1, further including a belt attached to said back panel with a belt attachment means, said belt further having a belt connection means to secure a first side of said belt to a second side of said belt when said belt is wrapped around a user.

14. The configurable bag of claim 13, wherein said belt attachment means is at least one of a zipper, a hook and loop closure, and a plurality of snaps.

15. The configurable bag of claim 1, wherein said main bag compartment includes a plurality of straps arranged in a woven pattern.

16. The configurable bag of claim 1, wherein said cover attachment means comprises a hook and loop closure.

17. The configurable bag of claim 1, wherein said attachment means comprise a first attachment means, a second attachment means, a third attachment means and a fourth attachments means such that:

when said foldable bag body is in said first configuration, said first and second attachment means are selectively engageable with one another to connect a first side panel of said plurality of side panels to a second side panel of said plurality of side panels while said third and fourth attachment means are selectively engageable with one another to connect a third side panel of said plurality of side panels to a fourth side panel of said plurality of side panels; and when said foldable bag body is in said second configuration, said first and fourth attachment means are selectively engageable with one another to connect said first side panel of said plurality of side panels to said fourth side panel of said plurality of side panels to provide said overlap for said second and third side panels of said plurality of side panels.

18. The configurable bag of claim 17, wherein said overlap provides a cover for at least a majority of said closeable opening.

19. The configurable bag of claim 1, wherein when said foldable bag body is in said second configuration, said main bag compartment defines a compressed profile that possesses a reduced carrying capacity relative to when said foldable bag body is in said first configuration.

* * * * *